United States Patent [19]

Carlson et al.

[11] 4,233,579

[45] Nov. 11, 1980

[54] TECHNIQUE FOR SUPPRESSING SPURIOUS RESONANCES IN STRIP TRANSMISSION LINE CIRCUITS

[75] Inventors: Eric R. Carlson, Fair Haven; Martin V. Schneider, Holmdel; Ralph F. Trambarulo, Red Bank, all of N.J.

[73] Assignee: Bell Telephone Laboratories, Incorporated, Murray Hill, N.J.

[21] Appl. No.: 45,992

[22] Filed: Jun. 6, 1979

[51] Int. Cl.[3] ..... H01P 1/203; H01P 3/08

[52] U.S. Cl. ..... 333/204; 333/238

[58] Field of Search ..... 333/161, 204, 205, 238; 343/700 MS

[56] References Cited

U.S. PATENT DOCUMENTS

| | | | |
|---|---|---|---|
| 2,411,555 | 11/1946 | Rogers | 333/204 |
| 2,558,748 | 7/1951 | Haeff | 333/202 |
| 2,915,716 | 12/1959 | Hattersley | 333/204 |
| 2,922,968 | 1/1960 | Van Patten | 333/204 |
| 3,095,548 | 6/1963 | Manwaring | 333/175 |
| 3,189,852 | 6/1965 | Tsuchiya | 333/197 |
| 3,281,725 | 10/1966 | Albsmeier | 333/197 |
| 3,879,690 | 4/1975 | Golant et al. | 333/204 |
| 4,138,684 | 2/1979 | Kerr | 343/700 MS |

*Primary Examiner*—Eli Lieberman

*Attorney, Agent, or Firm*—Erwin W. Pfeifle

[57] ABSTRACT

The present invention relates to a technique for displacing spurious resonances which are excited in strip transmission line circuits outside the frequency band of interest. Such displacement is accomplished by adding apertures in the capacitive elements of the strip transmission line circuit which have dimensions to move the transverse resonances out of frequency band of interest while causing, for example, no significant change in the passband ripple or the stopband attenuation of a filter. The slots effectively cause the inductance across the capacitive element to increase and, therefore, lower the frequency of the transverse modes or resonances.

7 Claims, 9 Drawing Figures

TECHNIQUE FOR SUPPRESSING SPURIOUS RESONANCES IN STRIP TRANSMISSION LINE CIRCUITS

BACKGROUND OF THE INVENTION

1. Field of the Invention

The present invention relates to a technique for suppressing spurious resonances in strip transmission line circuits and, more particularly, to a technique which displaces the spurious resonant frequencies outside the frequency band of interest by the addition of longitudinal slots in the capacitive elements of the strip transmission line circuits.

2. Description of the Prior Art

Strip transmission line circuits have been used in a variety of ways with the strip transmission line filter being the primary arrangement found. A typical prior art strip transmission line filter design is shown in U.S. Pat. No. 2,411,555 issued to D. C. Rogers on Nov. 26, 1946 which relates to a strip transmission line microwave filter including the general design of an L-C network comprising a pattern of alternate wide and narrow portions of conducting material similar to that of the present invention.

With such filters, undesired resonances can be introduced which should preferably be compensated for. For example, U.S. Pat. No. 3,879,690 issued to B. Golant et al on Apr. 22, 1975 relates to a distributed transmission line filter comprising a pattern of alternate wide and narrow symmetrical sections. In accordance with the Golant et al arrangement, an undesired resonance is prevented in a distributed transmission line filter comprising a center conductor having serially connected inductive and capacitive sections separated from a ground conductor by a dielectic substrate having a first thickness for filter inductive sections and a second thickness for at least one of filter capacitive sections.

Spurious sharp resonances can exist in the filters, and if excited by the circuit containing the filter, these modes can degrade the performance of the circuit. The problem remaining in the prior art, therefore, is to provide a technique for use with strip transmission line circuits which removes the spurious sharp resonances from the frequency band of interest to avoid performance degradation.

SUMMARY OF THE INVENTION

The foregoing problem has been solved in accordance with the present invention which relates to a technique for suppressing spurious resonances in strip transmission line circuits and, more particularly, to a technique which displaces the spurious resonant frequencies outside the frequency band of interest by the addition of an aperture in each of the capacitive elements of the strip transmission line circuit.

It is an aspect of the present invention to provide a technique for substantially suppressing spurious resonances in strip transmission line circuits in the frequency band of interest by displacing the resonant frequencies outside the frequency band of interest. Such displacement is accomplished by adding apertures in the capacitive elements of the strip tansmission line circuit which have dimensions to move the transverse resonances out of frequency band of interest while, for example, causing no significant change in the passband ripple or the stopband attenuation of a filter. The apertures effectively cause the inductance across the capacitive elements to increase and, therefore, lower the frequency of the transverse modes or resonances.

Other and further aspects of the present invention will become apparent during the course of the following description and by reference to the accompanying drawings.

BRIEF DESCRIPTION OF THE DRAWING

Referring now to the drawings, in which like numerals represent like parts in the several views.

DETAILED DESCRIPTION

The present invention is described primarily in association with a strip transmission line filter circuit. However, it will be understood that such description is exemplary only and is for the purpose of exposition and not for purposes of limitation. It will be readily appreciated that the inventive concept described is equally applicable to other forms of strip transmission line circuits and should be useful generally when it is necessary to change the resonant frequency of a transverse mode in a strip transmission line circuit element.

Figure 1:
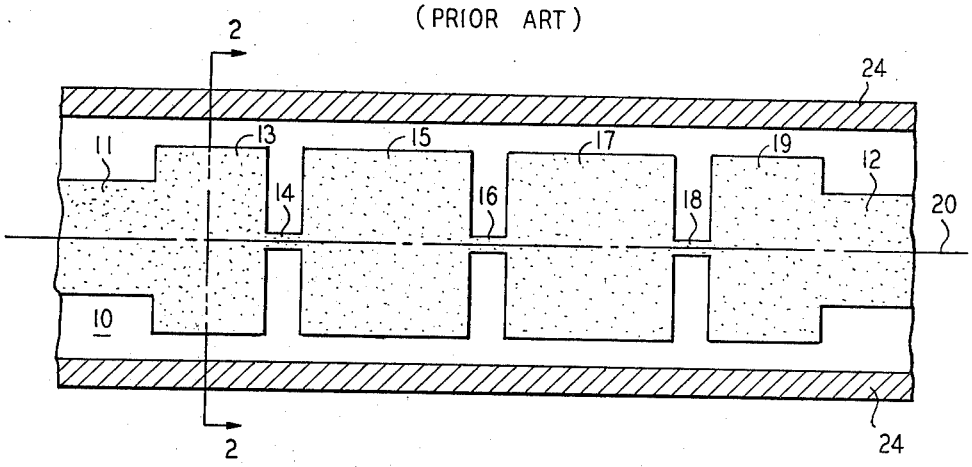
FIG. 1 (PRIOR ART)
FIG. 1 shows a top view of a prior art seven element Tchebyscheff response low-pass strip transmission line filter.
Figure 2:
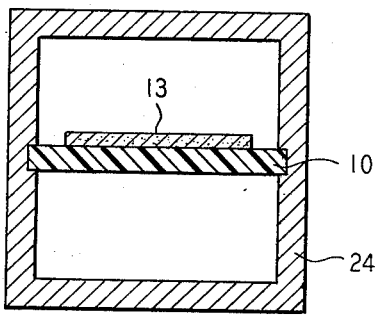
FIG. 2 (PRIOR ART)
FIG. 2 shows a cross-sectional view of a suspended substrate microstrip filter shown in FIG. 1.

In the prior art, strip transmission line filters generally comprise a first and a second layer of electrically conductive material associated with a dielectric substrate where at least one of the conductive layers includes a predetermined pattern of differently shaped sections. An example of a patterned conductive layer in a prior art suspended substrate microstrip filter which can be used, for example, in a low-freqency model of a millimeter-wave downconverter is shown in FIG. 1. The suspended substrate microstrip is but one form of a strip transmission line configuration and is used for purposes of exposition hereinafter and not for purposes of limitation. A cross-sectional view along line 2—2 in FIG. 1 is shown in FIG. 2.

Figure 3:
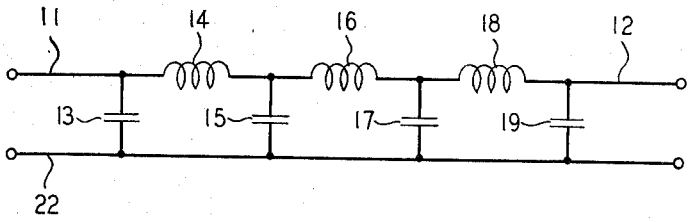
FIG. 3 (PRIOR ART)
FIG. 3 is a lumped-element equivalent circuit for the prior art filter shown in FIG. 1.

The filter of FIG. 1 is an outline drawing of one patterned conductive layer of a prior art seven element Tchebyscheff response low-pass strip transmission line filter formed on a dielectric substrate 10 comprising an input lead strip 11 and an output lead strip 12 interconnected by alternating wide conductive sections 13, 15, 17 and 19, forming separate shunt capacitive elements, and narrow conductive sections 14, 16 and 18, forming separate series inductive elements disposed along a central longitudinal axis 20. The equivalent circuit for the arrangement of FIG. 1 is well-known and is shown in FIG. 3, where the circuit element designations correspond to the designations of the sections of FIG. 1 forming those elements. The lower lead 22 in FIG. 3 is derived from the metal shield 24 formed around the dielectric substrate 10 shown in FIG. 1 as explained hereinbefore. Such metal shield is indicated by the hatchings 24 in FIG. 1.

Figure 4:
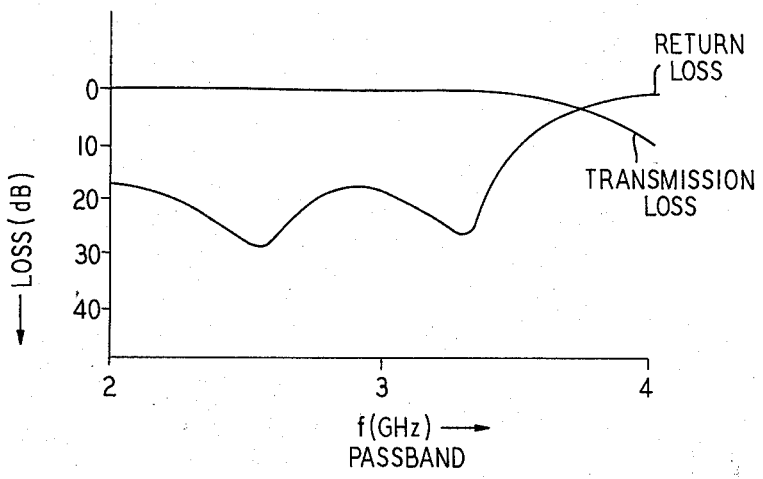
FIGS. 4 and 5 illustrate a passband and stopband portion, respectively, of a response curve for a specifically dimensioned filter of FIG. 1 including three transverse modes excited due to a filter asymmetry.
Figure 5:
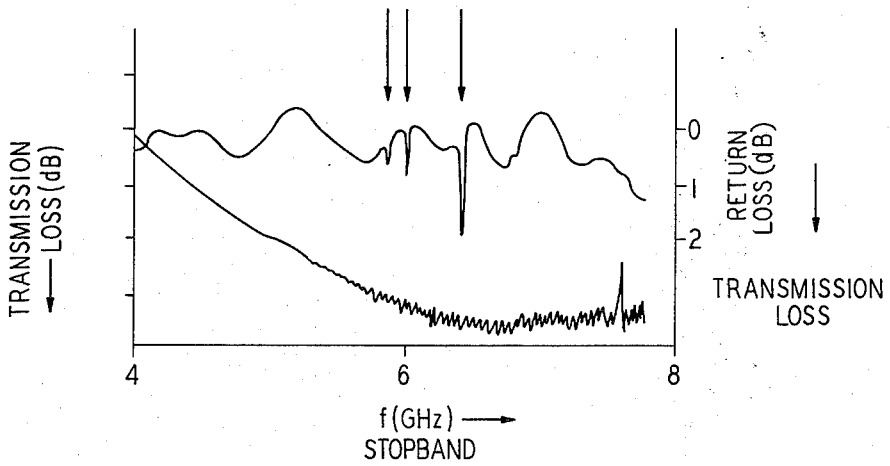

FIGS. 4 and 5 illustrate a response curve for the filter arrangement of FIG. 1 where substrate 10 has a width normal to axis 20 of approximately 17.83 mm; elements 11 and 12 have a width normal to axis 20 of approximately 9.30 mm; elements 13 and 19 have a width normal to axis 20 and a length parallel thereto of approximately 14.07 mm and 7.87 mm, respectively; elements 15 and 17 have a width and length of approximately 14.07 mm and 12.32 mm, respectively; elements 14 and 18 have a width and length of approximately 0.94 mm and 2.67 mm, respectively; and element 16 has a width and length of approximately 0.94 mm and 3.81 mm, respectively.

Sharp resonances can be excited in a strip transmission line filter by transverse asymmetries in the construction of the filter or of the strip transmission line circuit of which it is a part. Three such modes can be identified between 5.9 and 6.2 GHz in the return loss curve of FIG. 5 as indicated by the arrows above the curve. These modes were deliberately excited by placing a small capacitative tab asymmetrically on the strip transmission line adjacent to the element 13 or 19 of the filter nearest the signal generator. These transverse modes are undesirable because they can interfere with the operation of the circuit containing the filter. For example, transverse modes in the filter of FIG. 1 increased the conversion loss of the downconverter using the filter by more than 1 dB at several frequencies. If the filter is supposed to reflect certain of such frequencies, e.g., 6.2 GHz in FIG. 5, since they lie in a band of interest and fail to do so because of excited resonances, then signal degradation will occur.

Figure 6:
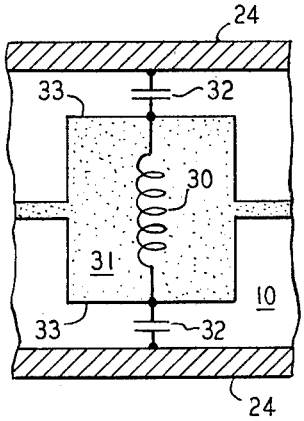
FIG. 6 is a model for the transverse modes shown in FIG. 5.

FIG. 6 illustrates a model for such transverse modes. Where the transverse asymmetry exists the modes arise from the resonance of the inductance 30 across a capacitative element 31 of the filter and fringe capacitance 32 between the edges 33 of the element 31 and ground. Each transverse mode was identified as being associated with a capacitative element 31 of the filter, which can correspond to elements 13, 15, 17 or 19 of FIG. 1, by observing the effect of placing a piece of dielectric or absorber on the edge of the element. It should be noted that transverse modes are inherent in the filter and, therefore, cannot be eliminated by design changes.

In accordance with the present invention, it has been found that transverse resonances can be moved out of the frequency band of interest by cutting apertures 40, 41, 42 and 43 in the capacitative elements 13, 15, 17 and 19, respectively. These apertures have been found to increase the inductance across the element and lower the frequency of the associated transverse mode, but have little effect on the desired filter response. Preferably the apertures are centrally oriented about the longitudinal axis 20 for best filter performance, but the present invention is not limited to such orientation. This novel technique is useful when design considerations limit the extent to which the width and length of the element can be modified to change the transverse mode frequency.

Figure 7:
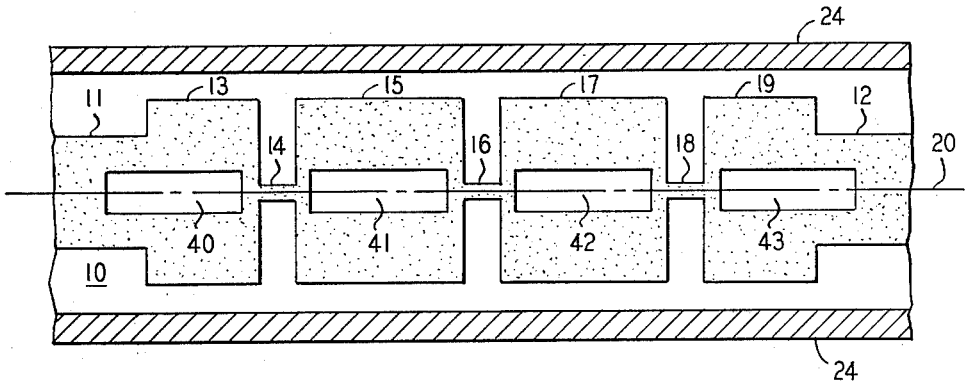
FIG. 7 is a design for the filter of FIG. 1 which is modified in accordance with the present invention for displacing the transverse modes from a frequency band of interest.
Figure 8:
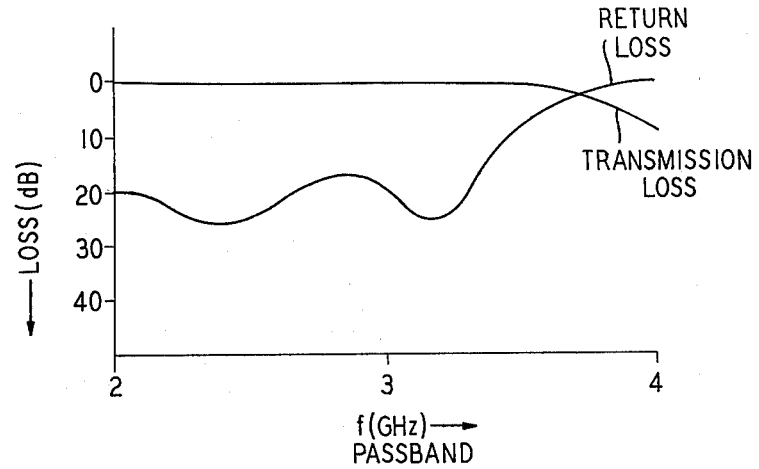
FIGS. 8 and 9 illustrate a passband and stopband portion, respectively, of a response curve for the filter circuit of FIG. 7 showing the displacement of the transverse mode into another portion of the curves of FIGS. 4 and 5.
Figure 9:
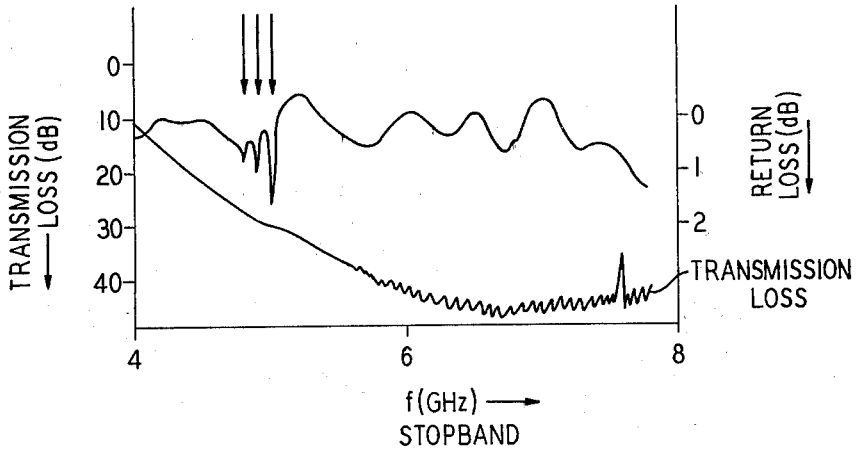

The design of the filter in FIG. 1 thus modified is shown in FIG. 7 and its associated response curves in FIGS. 8 and 9. The dimensions of the slots in FIG. 7 were determined empirically to move the transverse modes below 5.5 GHz and out of the frequency band of interest for this application. For the element dimensions given hereinbefore for the arrangement of FIG. 1, the slots 40, 41, 42 and 43 in FIG. 7 each have a width centered about axis 20 of approximately 3.05 mm and a length of approximately 12.83, 10.29, 10.29, and 10.29 mm, respectively, with the edges of each slot disposed approximately 1.02 mm from the edge of the associated capacitive element nearest the adjacent inductive element to achieve the curves of FIGS. 8 and 9. It can be seen from FIG. 9 that the slots which are rather large cause no significant change in the passband ripple or the stopband attenuation of the filter. The slots do not materially change the capacitance of each element since the fringing fields at the edge of the elements contributes most to the value of the capacitance, and the slot is in an area of least contribution to such value.

To achieve proper displacement of spurious resonances outside a frequency band of interest, the filter would first be set up, the location of the resonances observed using a response curve similar to that shown in FIGS. 4 and 5, and a narrow slot cut into the desired elements while monitoring the change in location of the resonances. The size of the slots can then be increased in small strips until it is observed that the resonances are sufficiently displaced outside the frequency band of interest.

It is to be understood that the above-described embodiments are simply illustrative of the principles of the invention. Various other modifications and changes may be made by those skilled in the art which will embody the principles of the invention and fall within the spirit and scope thereof.

We claim:

1. A strip transmission line circuit comprising a layer of an electrically conductive material which is deposited on a dielectric substrate (10), the layer being fabricated into a predetermined pattern of various width sections along a longitudinal axis (20) thereof to form various circuit elements which includes a wide section that forms a capacitive element (13, 15, 17 or 19)

CHARACTERIZED IN THAT the wide section forming the capacitive element comprises an aperture (40, 41, 42 or 43) having dimensions which cause transverse resonances that may be excited in the strip transmission line circuit to be displaced outside a desired frequency band of interest.

2. A strip transmission line circuit in accordance with claim 1 wherein the predetermined pattern comprises a serial connection of alternating wide and narrow sections which forms a network comprising shunt capacitive elements and either one of serial inductive and resistive elements, respectively,

CHARACTERIZED IN THAT each of the wide sections of the predetermined pattern comprises an aperture having dimensions for causing said transverse modes to be displaced outside said desired frequency band of interest.

3. A strip transmission line circuit in accordance with claim 1 or 2

CHARACTERIZED IN THAT each aperture is in the form of a slot having its longest dimension along the longitudinal axis of the pattern.

4. A strip transmission line circuit in accordance with claim 1 or 2

CHARACTERIZED IN THAT each aperture (40, 41, 42, or 43) is centrally oriented about said longitudinal axis (20).

5. A method of displacing transverse modes which are excited in a strip transmission line circuit in a frequency band of interest outside said frequency band where the strip transmission line circuit comprises a layer of an electrically conductive material which is fabricated into a predetermined pattern of various width sections along a longitudinal axis (20) thereof to form various circuit elements of a network which includes a wide section forming a portion of a capacitive elements (13, 15, 17 or 19)

CHARACTERIZED IN THAT the method comprises the step of:

(a) forming an aperture (41, 42, 43 or 44) in the wide section of the predetermined pattern forming the capacitive element of the network, the aperture having dimensions which cause the transverse modes to be displaced outside the frequency band of interest.

6. The method in accordance with claim 5 where the predetermined pattern comprises a plurality of wide sections (13, 15, 17 and 19) which form separate portions of a plurality of capacitive elements

CHARACTERIZED IN THAT the method comprises the additional step of:

(b) in performing step (a), forming an aperture (41, 42, 43 and 44) in each of the plurality of wide sections forming the capacitive elements, the apertures having dimensions which cause the transverse modes to be displaced outside the frequency band of interest.

7. The method in accordance with claim 5 or 6

CHARACTERIZED IN THAT the method comprising the additional step of:

(c) in performing step (a) and (b), forming each aperture such that its dimensions are centrally oriented about said longitudinal axis.

* * * * *